US008845365B2

(12) United States Patent
Schroll et al.

(10) Patent No.: US 8,845,365 B2
(45) Date of Patent: Sep. 30, 2014

(54) CABLE HEADER CONNECTOR

(75) Inventors: Neil Franklin Schroll, Mount Joy, PA (US); Julie Anne Lachman, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 201 days.

(21) Appl. No.: 13/314,458

(22) Filed: Dec. 8, 2011

(65) Prior Publication Data

US 2013/0149899 A1 Jun. 13, 2013

(51) Int. Cl.

| | |
|---|---|
| ***H01R 13/648*** | (2006.01) |
| ***H01R 13/514*** | (2006.01) |
| ***H01R 12/50*** | (2011.01) |
| *H01R 13/6593* | (2011.01) |

(52) U.S. Cl.

CPC ..... *H01R 23/6873* (2013.01); *H01R 13/6593* (2013.01); *H01R 13/514* (2013.01)

USPC ..... 439/607.27; 439/607.56

(58) Field of Classification Search

USPC ..... 439/607.01, 607.27, 607.55, 607.56, 439/607.41, 607.44

See application file for complete search history.

(56) References Cited

U.S. PATENT DOCUMENTS

| | | | | |
|---|---|---|---|---|
| 6,080,018 | A | 6/2000 | Ferrill et al. | |
| 6,261,127 | B1 * | 7/2001 | Miskin et al. | 439/607.41 |
| 6,380,485 | B1 | 4/2002 | Beaman et al. | |
| 6,471,549 | B1 | 10/2002 | Lappohn | |
| 7,267,515 | B2 | 9/2007 | Lappohn | |
| 7,410,393 | B1 | 8/2008 | Rothermel et al. | |
| 7,566,247 | B2 | 7/2009 | Rothermel et al. | |
| 7,637,767 | B2 * | 12/2009 | Davis et al. | 439/352 |
| 8,109,789 | B2 * | 2/2012 | Tyler | 439/587 |
| 8,475,208 | B2 * | 7/2013 | Simpson et al. | 439/607.01 |
| 2006/0105632 | A1 | 5/2006 | Szczesny et al. | |
| 2010/0009571 | A1 | 1/2010 | Scherer et al. | |
| 2011/0256764 | A1 * | 10/2011 | Wu | 439/607.01 |
| 2012/0045934 | A1 * | 2/2012 | Wu | 439/607.01 |

OTHER PUBLICATIONS

International Search Report, International Application No. PCT/2012/066528, International Filing Date Nov. 26, 2012.

* cited by examiner

*Primary Examiner* — Neil Abrams
*Assistant Examiner* — Travis Chambers

(57) ABSTRACT

A cable header connector includes a cable assembly having a contact sub-assembly terminated to a cable, a ground ferrule electrically connected to a drain wire of the cable and a ground shield coupled to the ground ferrule and providing electrical shielding for the contact sub-assembly. The contact sub-assembly has a mounting block supporting a pair of signal contacts. The signal contacts extend between mating ends and terminating ends. The signal contacts are terminated to corresponding signal wires of the cable at the terminating ends. The ground shield has walls extending along the signal contacts, and has a mating end and a terminating end. The ground ferrule has a ferrule body with a drain wire slot receiving and electrically connected to the drain wire of the cable. The ferrule body engages the ground shield to electrically connect the ground shield to the grounded element.

19 Claims, 7 Drawing Sheets

CABLE HEADER CONNECTOR

CROSS REFERENCE TO RELATED APPLICATIONS

This application relates to U.S. patent application Ser. No. 13/314,336 titled CABLE HEADER CONNECTOR filed Dec. 8, 2011, to U.S. patent application Ser. No. 13/314,380 titled CABLE HEADER CONNECTOR filed Dec. 8, 2011, and to U.S. patent application Ser. No. 314,415 titled CABLE HEADER CONNECTOR filed Dec. 8, 2011, the subject matter of each of which is herein incorporated by reference in its entirety.

BACKGROUND OF THE INVENTION

The subject matter herein relates generally to cable header connectors.

High speed differential connectors are known and used in electrical systems, such as communication systems to transmit signals within a network. Some electrical systems utilize cable mounted electrical connectors to interconnect the various components of the system.

Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other.

Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, at the interface between the signal conductors and the cables signal degradation is problematic due to improper shielding at such interface. The termination of the cable to the signal conductors is a time consuming and complicated process. In some systems, the cables include drain wires, which are difficult and time consuming to terminate within the connector due to their relatively small size and location in the cable. For example, the drain wires are soldered to a grounded component of the electrical connector, which is time consuming. Furthermore, general wiring practices require that the drain either be placed facing upward or placed facing downward at the termination, which adds complexity to the design of the grounded component of the electrical connector and difficulty when soldering the drain wire at assembly. Motion of the cable during handling can add unwanted stresses and strains to the cable terminations resulting in discontinuity or degraded electrical performance. Additionally, consistent positioning of the wires of the cables before termination is difficult with known electrical connectors and improper positioning may lead to degraded electrical performance at the termination zone. When many cable assemblies are utilized in a single electrical connector, the grounded components of the cable assemblies are not electrically connected together, which leads to degraded electrical performance of the cable assemblies.

A need remains for an electrical system having improved shielding to meet particular performance demands.

BRIEF DESCRIPTION OF THE INVENTION

In one embodiment, a cable header connector is provided including a contact sub-assembly having a pair of signal contacts. The signal contacts are configured to be terminated to corresponding signal wires of a cable. A ground shield extends along and provides electrical shielding for the signal contacts of the contact sub-assembly. The ground shield has a terminating end. A ground ferrule is configured to be electrically connected to a grounded element of the cable. The ground ferrule engages the ground shield to electrically connect the ground shield to the grounded element.

In another embodiment, a cable header connector is provided including a cable assembly having a contact sub-assembly configured to be terminated to a cable, a ground ferrule configured to be electrically connected to a grounded element of the cable and a ground shield coupled to the ground ferrule and providing electrical shielding for the contact sub-assembly. The contact sub-assembly has a mounting block supporting a pair of signal contacts. The signal contacts extend between mating ends and terminating ends. The signal contacts are terminated to corresponding signal wires of the cable at the terminating ends. The ground shield has walls extending along the signal contacts, and has a mating end and a terminating end. The ground ferrule has a ferrule body configured to engage and be electrically connected to the grounded element of the cable. The ferrule body engages the ground shield to electrically connect the ground shield to the grounded element.

In a further embodiment, a cable header connector is provided having a cable assembly that includes a contact sub-assembly configured to be terminated to a cable, a ground ferrule configured to be electrically connected to a drain wire of the cable and a ground shield coupled to the ground ferrule and providing electrical shielding for the contact sub-assembly. The contact sub-assembly has a mounting block supporting a pair of signal contacts. The signal contacts extend between mating ends and terminating ends. The signal contacts are terminated to corresponding signal wires of the cable at the terminating ends. The ground shield has walls extending along the signal contacts, and has a mating end and a terminating end. The ground ferrule has a ferrule body with a drain wire slot configured to receive and be electrically connected to the drain wire of the cable. The ferrule body engages the ground shield to electrically connect the ground shield to the grounded element.

DETAILED DESCRIPTION OF THE INVENTION

Figure 1:
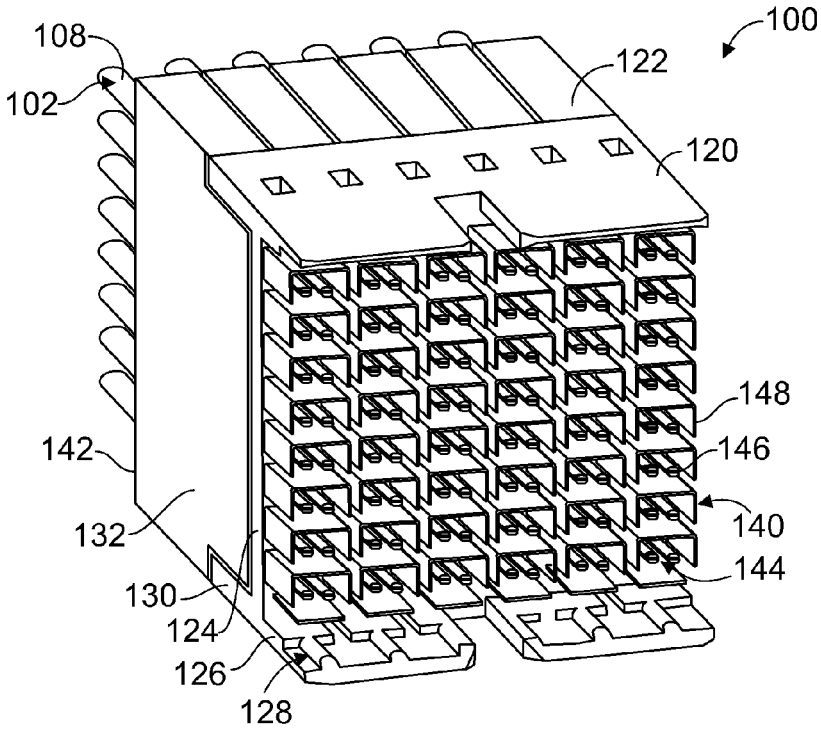
FIG. 1 is a front perspective view of a cable header connector formed in accordance with an exemplary embodiment.
Figure 2:
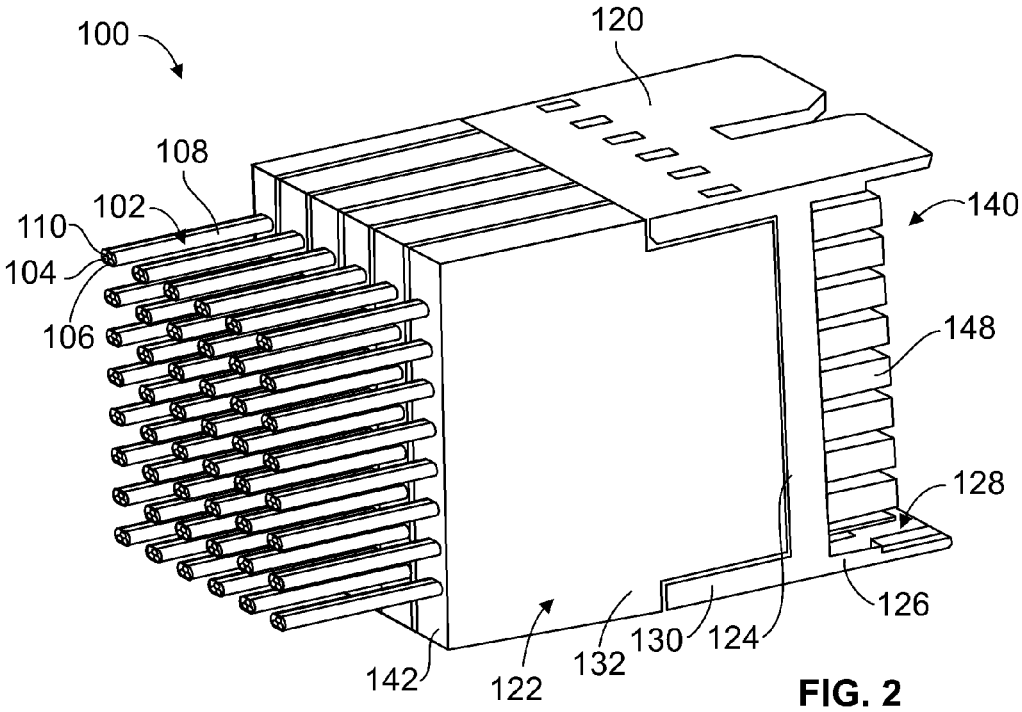
FIG. 2 is a rear perspective of the cable header connector shown in FIG. 1.

FIG. 1 is a front perspective view of a cable header connector 100 formed in accordance with an exemplary embodiment. FIG. 2 is a rear perspective of the cable header connector 100. The cable header connector 100 is configured to be mated with a receptacle connector (not shown). The receptacle connector may be board mounted to a printed circuit board or terminated to one or more cables, for example. The cable header connector 100 is a high speed differential pair cable connector that includes a plurality of differential pairs of conductors mated at a common mating interface. The differential conductors are shielded along the signal paths thereof to reduce noise, crosstalk and other interference along the signal paths of the differential pairs.

A plurality of cables 102 extend rearward of the cable header connector 100. In an exemplary embodiment, the cables 102 are twin axial cables having two signal wires 104, 106 within a common jacket 108 of the cable 102. In an exemplary embodiment, each of the signal wires 104, 106 are individually shielded, such as with a cable braid. The cable braids define grounded elements of the cable 102. A drain wire 110 is also provided within the jacket 108 of the cable 102. The drain wire 110 is electrically connected to the shielding of the signal wires 104, 106. The drain wire 110 defines a grounded element of the cable 102. Optionally, the cable 102 may include cable braids surrounding the signal wires 104, 106 that define grounded elements. The signal wires 104, 106 convey differential signals. The grounded elements of the cable 102 provide shielding for the signal wires 104, 106 into the cable header connector 100. Other types of cables 102 may be provided in alternative embodiments. For example, coaxial cables may extend from the cable header connector 100 carrying a single signal conductor therein.

The cable header connector 100 includes a header housing 120 holding a plurality of contact modules 122. The header housing 120 includes a base wall 124. The contact modules 122 are coupled to the base wall 124. In the illustrated embodiment, the header housing 120 includes shroud walls 126 extending forward from the base wall 124 to define a mating cavity 128 of the cable header connector 100. The shroud walls 126 guide mating of the cable header connector 100 with the receptacle connector during mating thereto. In the illustrated embodiment, the header housing 120 has support walls 130 extending rearward from the base wall 124. The contact modules 122 are coupled to the support walls 130. The support walls 130 may include features to guide the contact modules 122 into position with respect to the header housing 120 during mating of the contact modules 122 to the header housing 120. The support walls 130 define a module cavity 132 that receives at least portions of the contact modules 122 therein. The support walls 130 may include latching features that engage the contact modules 122 to secure the contact modules 122 to the header housing 120.

Each of the contact modules 122 include a plurality of cable assemblies 140 held by a support body 142. Each cable assembly 140 includes a contact sub-assembly 144 configured to be terminated to a corresponding cable 102. The contact sub-assembly 144 includes a pair of signal contacts 146 terminated to corresponding signal wires 104, 106. The cable assembly 140 also includes a ground shield 148 providing shielding for the signal contacts 146. In an exemplary embodiment, the ground shield 148 peripherally surrounds the signal contacts 146 along the entire length of the signal contacts 146 to ensure that the signal paths are electrically shielded from interference.

The support body 142 provides support for the contact sub-assembly 144 and ground shield 148. In an exemplary embodiment, the cables 102 extend into the support body 142 such that the support body 142 supports a portion of the cables 102. The support body 142 may provide strain relief for the cables 102. Optionally, the support body 142 may be manufactured from a plastic material. Alternatively, the support body 142 may be manufactured from a metal material. The support body 142 may be a metalized plastic material to provide additional shielding for the cables 102 and the cable assemblies 140. The support body 142 is sized and shaped to fit into the module cavity 132 and engage the support walls 130 to secure the contact modules 122 to the header housing 120.

Figure 3:
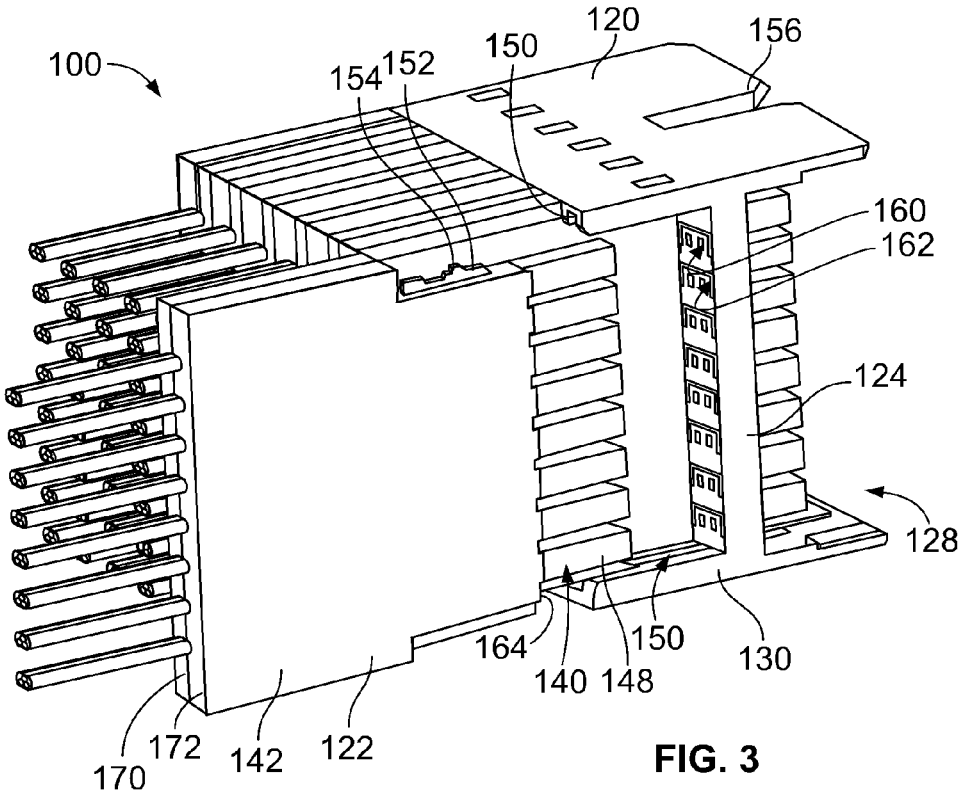
FIG. 3 is a rear perspective view of the cable header connector showing a contact module poised for loading into a header housing of the cable header connector.

FIG. 3 is a rear perspective view of the cable header connector 100 with one of the contact modules 122 outside of the header housing 120 and poised for loading into the header housing 120. The header housing 120 includes guide channels 150 in the support walls 130 to guide the contact module 122 into the header housing 120. The contact modules 122 include guide features 152 at the top and bottom of the support body 142 that are received in guide channels 150 for guiding the contact module 122 into the header housing 120.

In an exemplary embodiment, the contact module 122 includes a latch 154 that engages a corresponding latch element 156 (e.g. an opening) on the header housing 120 to secure the contact module 122 in the header housing 120. In the illustrated embodiment, the latch 154 on the contact module 122 is an extension extending outward from the guide feature 152, while the latch element 156 on the header housing 120 is an opening that receives the latch 154. Other types of latching features may be used in alternative embodiments to secure the contact module 122 to the header housing 120.

The header housing 120 includes a plurality of signal contact openings 160 through the base wall 124. The header housing 120 includes a plurality of ground shield openings 162 through the base wall 124. When the contact module 122 is coupled to the header housing 120, the signal contacts 146 (shown in FIGS. 1 and 2) are received in corresponding signal contact openings 160. The ground shield 148 is received in corresponding ground shield openings 162. The signal contact openings 160 and ground shield openings 162 may include lead-in features, such as chamfered surfaces, that guide the signal contacts 146 and ground shield 148 into the corresponding openings 160, 162, respectively. Portions of the signal contacts 146 and ground shield 148 extend forward from a front 164 of the support body 142. Such portions of the signal contacts 146 and ground shield 148 are loaded through the base wall 124 into the mating cavity 128 for mating with the receptacle connector (not shown). The front 164 of the support body 142 abuts against, or nearly abuts against, the base wall 124 when the contact module 122 is loaded into the header housing 120.

Multiple contact modules 122 are loaded into the header housing 120. The header housing 120 holds the contact modules 122 in parallel such that the cable assemblies 140 are aligned in a column. Any number of contact modules 122 may be held by the header housing 120 depending on the particular application. When the contact modules 122 are stacked in the header housing 120, the cable assemblies 140 may also be aligned in rows.

In the illustrated embodiment, the contact module 122 includes a first holder 170 and a second holder 172 coupled to the first holder 170. The first and second holders 170, 172 define the support body 142. The first and second holders 170, 172 hold the cable assemblies 140 therebetween. Optionally, the first and second holders 170, 172 may generally be mirrored halves that are coupled together and sandwich the cable assemblies 140 therebetween. Alternatively, the first and second holders 170, 172 may be differently sized and shaped, such as where one holder is a cover or plate that covers one side of the other holder.

Figure 4:
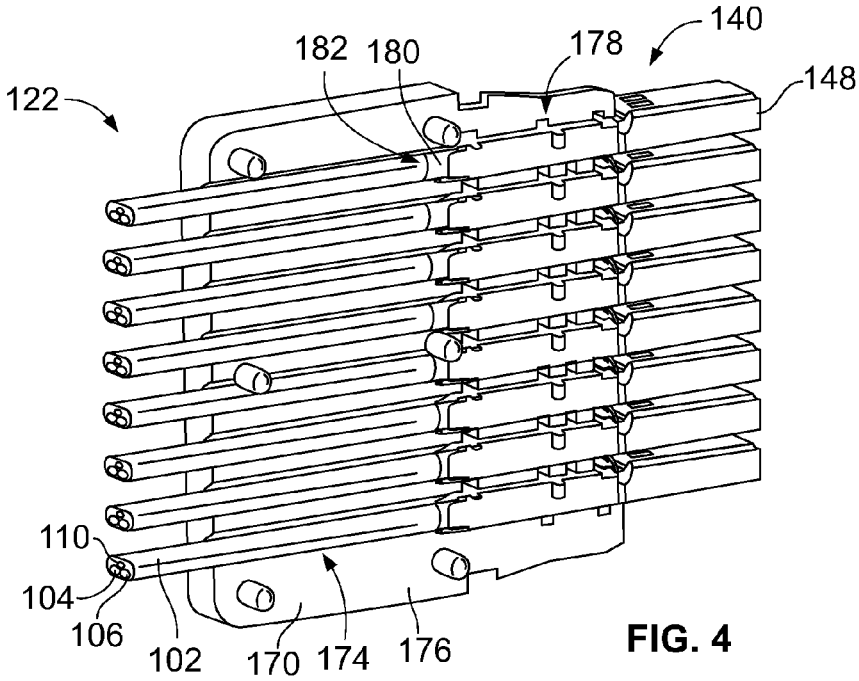
FIG. 4 is a perspective view of a portion of the contact module shown in FIG. 3.

FIG. 4 is a perspective view of a portion of the contact module 122 with the second holder 172 (shown in FIG. 3) removed to illustrate the cable assemblies 140 and cables 102. The first holder 170 includes a plurality of channels 174 at an interior 176 thereof. The channels 174 receive the cable assemblies 140 and the cables 102. Optionally, the second holder 172 may include similar channels that receive portions of the cable assemblies 140 and cables 102. During assembly, the cable assemblies 140 and cables 102 are loaded into the channels 174 of the first holder 170 and then the second holder 172 is coupled to the first holder 170, securing the cable assemblies 140 and cables 102 therebetween. In an exemplary embodiment, the first holder 170 includes pockets 178 that receive portions of the cable assemblies 140 to axially secure the cable assemblies 140 within the channels 174. The interaction between the cable assemblies 140 and the pockets 178 function as strain relief features for the cable assemblies 140 and cables 102.

In an exemplary embodiment, a ground ferrule 180 is coupled to an end 182 of the cable 102. The ground ferrule 180 is electrically connected to one or more grounded elements of the cable 102, such as the drain wire 110 (shown in FIG. 1) and/or the cable braids of the signal wires 104, 106 (shown in FIG. 1). The ground ferrule 180 is manufactured from a metal material and is electrically conductive. The ground shield 148 is electrically connected to the ground ferrule 180 to create a ground path between the cable assembly 140 and the cable 102.

Figure 5:
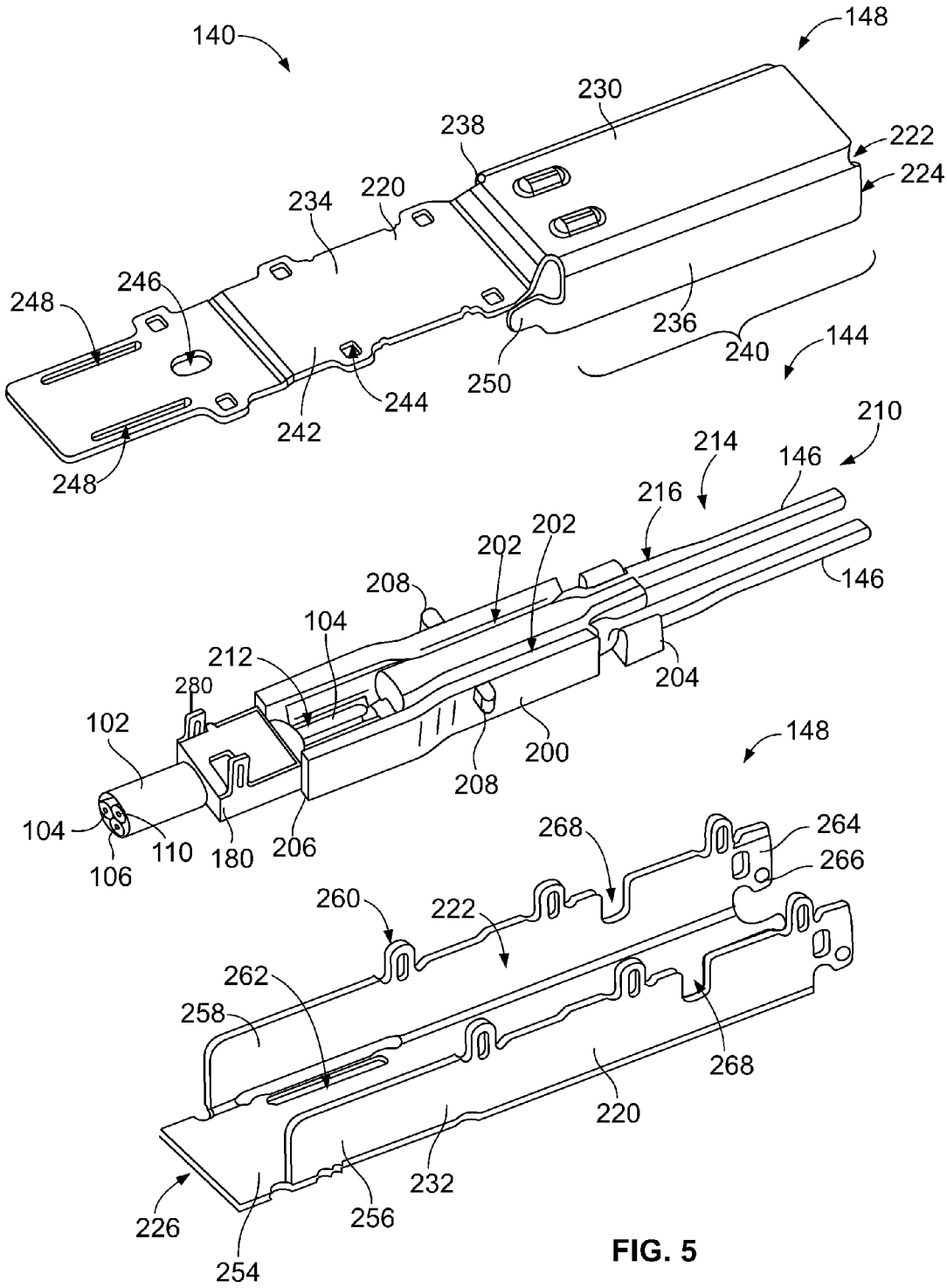
FIG. 5 is an exploded view of a cable assembly of the contact module.

FIG. 5 is an exploded view of one of the cable assemblies 140 illustrating the ground shield 148 poised for coupling to the contact sub-assembly 144. The contact sub-assembly 144 includes a mounting block 200 that holds the signal contacts 146. The mounting block 200 is positioned forward of the cable 102. The signal wires 104, 106 extend into the mounting block 200 for termination to the signal contacts 146. The mounting block 200 includes contact channels 202 that receive corresponding signal contacts 146 therein. The contact channels 202 are generally open at a top of the mounting block 200 to receive the signal contacts 146 therein, but may have other configurations in alternative embodiments. The mounting block 200 includes features to secure the signal contacts 146 in the contact channels 202. For example, the signal contacts 146 may be held by an interference fit in the contact channels 202.

The mounting block 200 extends between a front 204 and a rear 206. In an exemplary embodiment, the signal contacts 146 extend forward from the mounting block 200 beyond the front 204. The mounting block 200 includes locating posts 208 extending from opposite sides of the mounting block 200. The locating posts 208 are configured to position the mounting block 200 with respect to the ground shield 148 when the ground shield 148 is coupled to the mounting block 200.

The signal contacts 146 extend between mating ends 210 and terminating ends 212. The signal contacts 146 are terminated to corresponding signal wires 104, 106 of the cable 102 at the terminating ends 212. For example, the terminating ends 212 may be welded, such as by resistance welding or ultrasonic welding, to exposed portions of the conductors of the signal wires 104, 106. Alternatively, the terminating ends 212 may be terminated by other means or processes, such as by soldering the terminating ends 212 to the signal wires 104, 106, by using insulation displacement contacts, or by other means. The signal contacts 146 may be stamped and formed or may be manufactured by other processes.

In an exemplary embodiment, the signal contacts 146 have pins 214 at the mating ends 210. The pins 214 extend forward from the front 204 of the mounting block 200. The pins 214 are configured to be mated with corresponding receptacle contacts (not shown) of the receptacle connector (not shown). Optionally, the pins 214 may include a wide section 216 proximate to the mounting block 200. The wide section 216 is configured to be received in the signal contact openings 160 (shown in FIG. 3) of the header housing 120 (shown in FIG. 3) and held in the signal contact openings 160 by an interference fit. The narrower portions of the pins 214 forward of the wide section 216 may more easily be loaded through the signal contact openings 160 as the contact module 122 is loaded into the header housing 120 due to their decreased size, while the wide section 216 engages the header housing 120 to precisely locate the pins 214 forward of the header housing 120 for mating with the receptacle connector.

The ground shield 148 has a plurality of walls 220 that define a receptacle 222 that receives the contact sub-assembly 144. The ground shield 148 extends between a mating end 224 and a terminating end 226. The mating end 224 is configured to be mated with the receptacle connector. The terminating end 226 is configured to be electrically connected to the ground ferrule 180 and/or the cable 102. The mating end 224 of the ground shield 148 is positioned either at or beyond the mating ends 210 of the signal contacts 146 when the cable assembly 140 is assembled. The terminating end 226 of the ground shield 148 is positioned either at or beyond the terminating ends 212 of the signal contacts 146. The ground shield 148 provides shielding along the entire length of the signal contacts 146. In an exemplary embodiment, the ground shield 148 provides shielding beyond the signal contacts 146, such as rearward of the terminating ends 212 and/or forward of the mating ends 210. The ground shield 148, when coupled to the contact sub-assembly 144, peripherally surrounds the signal contacts 146. Because the ground shield 148 extends rearward beyond the terminating ends 212 of the signal contacts 146, the termination between the signal contacts 146 and the signal wires 104, 106 is peripherally surrounded by the ground shield 148. In an exemplary embodiment, the ground shield 148 extends along at least a portion of the cable 102 such that the ground shield 148 peripherally surrounds at least part of the cable braids of the signal wires 104, 106 and/or cable 102, ensuring that all sections of the signal wires 104, 106 are shielded.

The ground shield 148 includes an upper shield 230 and a lower shield 232. The receptacle 222 is defined between the upper and lower shields 230, 232. The contact sub-assembly 144 is positioned between the upper shield 230 and the lower shield 232.

In an exemplary embodiment, the upper shield 230 includes an upper wall 234 and side walls 236, 238 extending from the upper wall 234. The upper shield 230 includes a shroud 240 at the mating end 224 and a tail 242 extending rearward from the shroud 240 to the terminating end 226. The tail 242 is defined by the upper wall 234. The shroud 240 is defined by the upper wall 234 and the side walls 236, 238. In an exemplary embodiment, the shroud 240 is C-shaped and has an open side along the bottom thereof. The shroud 240 is configured to peripherally surround the pins 214 of the signal contacts 146 on three sides thereof. The upper shield 230 may have different walls, components and shapes in alternative embodiments.

The tail 242 includes press-fit features 244 that are used to secure the upper shield 230 to the lower shield 232. Other types of securing features may be used in alternative embodiments. In the illustrated embodiment, the press-fit features 244 are openings through the upper wall 234.

The tail 242 includes a drain wire opening 246 that receives at least a portion of the drain wire 110. The drain wire opening 246 may receive at least a portion of the ground ferrule 180 in addition to the drain wire 110.

The tail 242 includes ground ferrule slots 248 that receive portions of the ground ferrule 180. The ground ferrule slots 248 may be elongated. The ground shield 148 may engage the ground ferrule 180 at the ground ferrule slots 248 to electrically couple the ground ferrule 180 to the ground shield 148.

The shroud 240 includes tabs 250 extending rearward from the side walls 236, 238. The tabs 250 are configured to engage the lower shield 232 to electrically connect the upper shield 230 to the lower shield 232.

In an exemplary embodiment, the lower shield 232 includes a lower wall 254 and side walls 256, 258 extending upward from the lower wall 254. The lower shield 232 includes press-fit features 260 extending from the side walls 256, 258. The press-fit features 260 are configured to engage the press-fit features 244 of the upper shield 230 to secure the lower shield 232 to the upper shield 230. In the illustrated embodiment, the press-fit features 260 are compliant pins that are configured to be received in the openings defined by the press-fit features 244. Other types of securing features may be used in alternative embodiments to secure the lower shield 232 to the upper shield 230. The lower shield 232 may include a drain wire opening (not shown) similar to the drain wire opening 246 of the upper shield 230 that is configured to receive at least a portion of the drain wire 110 and/or the ground ferrule 180. In an exemplary embodiment, the lower shield 232 includes ground ferrule slots 262 in the lower wall 254. The ground ferrule slots 262 may receive portions of the ground ferrule 180.

The lower shield 232 includes tabs 264 extending forward from the side walls 256, 258. The tabs 264 are configured to engage the tabs 250 of the upper shield 230 to electrically connect the upper shield 230 to the lower shield 232. Optionally, the tabs 264 may include embossments 266 that extend from the tabs 264 to ensure engagement with the tabs 250. Optionally, the tops of the tabs 264 may be chamfered to guide mating of the tabs 264 with the tabs 250 during assembly of the ground shield 148.

The lower shield 232 includes openings 268 in the side walls 258. The openings 268 are configured to receive the locating posts 208 when the contact sub-assembly 144 is loaded into the ground shield 148. Other types of locating features may be used in alternative embodiments to position the contact sub-assembly 144 with respect to the ground shield 148 and/or to hold the axial position of the contact sub-assembly 144 with respect to the ground shield 148.

Figure 6:
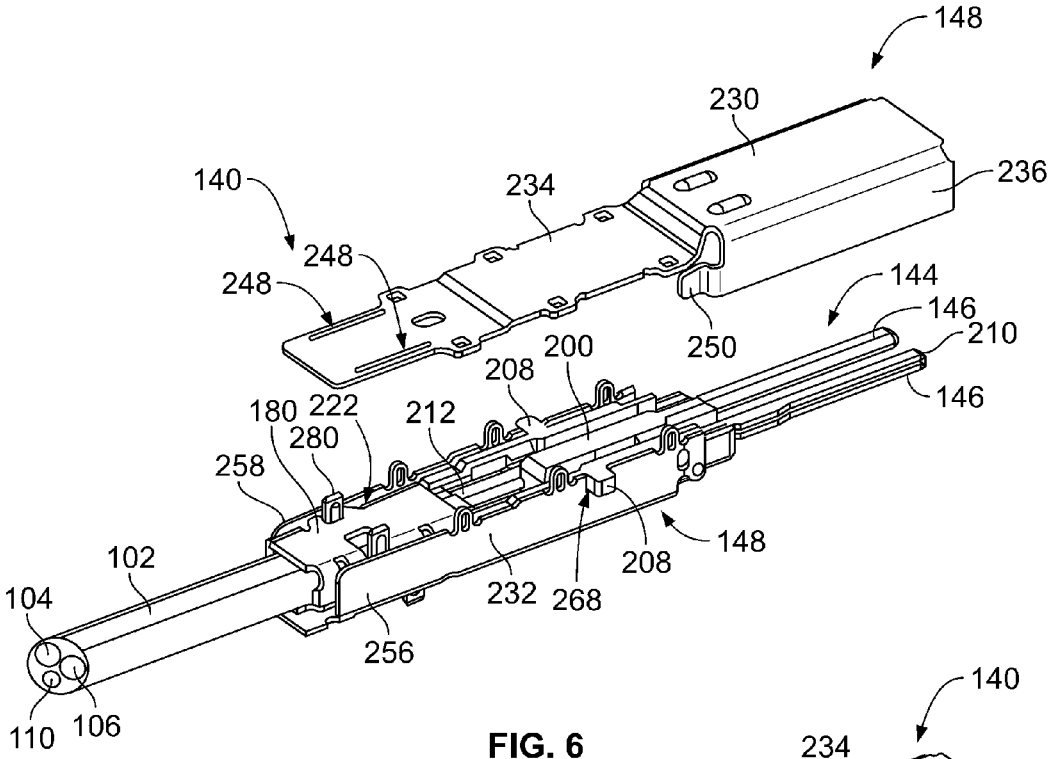
FIG. 6 is a partially assembled view of the cable assembly.
Figure 7:
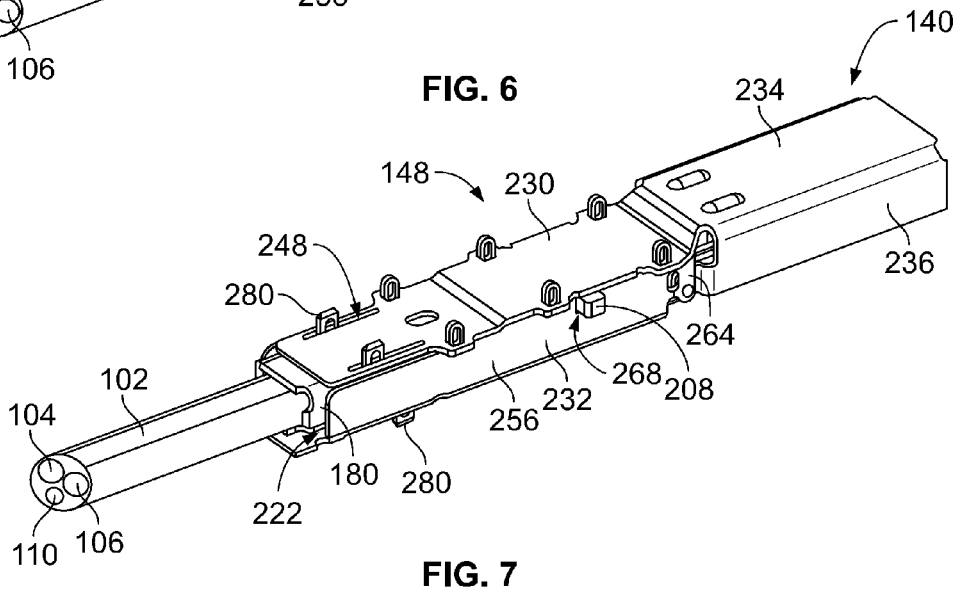
FIG. 7 is a top perspective view of the cable assembly.
Figure 8:
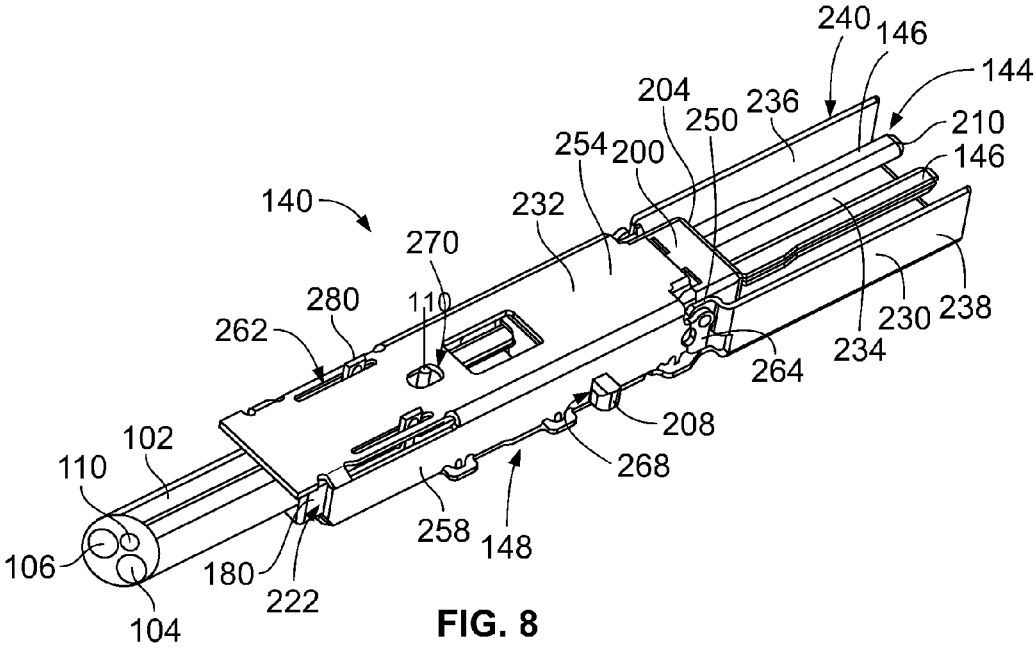
FIG. 8 is a bottom perspective view of the cable assembly.

FIG. 6 is a top perspective view of the cable assembly 140 showing the contact sub-assembly 144 loaded into the lower shield 232 with the upper shield 230 poised for mounting to the lower shield 232. FIG. 7 is a top perspective view of the cable assembly 140 showing the upper shield 230 coupled to the lower shield 232. FIG. 8 is a bottom perspective view of the cable assembly 140.

When the contact sub-assembly 144 is loaded into the receptacle 222, the mounting block 200 is positioned within the tower shield 232. The locating posts 208 are received in the openings 268 to secure the axial position of the contact sub-assembly 144 with respect to the ground shield 148. The ground ferrule 180 and a portion of the cable 102 are also received in the receptacle 222. The ground shield 148 provides peripheral shielding around the ground ferrule 180 and the cable 102. The ground ferrule 180 may be positioned immediately behind, and may engage, the mounting block 200 to provide strain relief for the cable 102 and/or the signal wires 104, 106. As shown in FIG. 8, the drain wire 110 extends through the drain wire opening 270 in the lower wall 254.

When the upper shield 230 and the lower shield 232 are coupled together, the tabs 280 of the ground ferrule 180 extend through the ground ferrule slots 262 of the lower shield 232 and extend through the ground ferrule slots 248 of the upper shield 230. The tabs 280 engage the lower shield 232 and the upper shield 230 to electrically connect the ground ferrule 180 to the ground shield 148. When the upper shield 230 and the lower shield 232 are coupled together, the tabs 250 of the upper shield 230 are held interior of the tabs 264 of the lower shield 232 and create an electrical path between the side walls 236, 238 of the upper shield 230 and the side walls 256, 258 of the lower shield 232.

The ground shield 148 provides electrical shielding for the signal contacts 146. The side walls 256, 258 of the lower shield 232 extend along sides of the signal contacts 146 and along side of the signal wires 104, 106, even within the cable 102. Similarly, the lower wall 254 of the lower shield 232 extends along a bottom of the signal contacts 146 and along a bottom of the signal wires 104, 106, including some length of the signal wires within the cable 102. When the upper shield 230 is coupled to the lower shield 232, the upper wall 234 extends along a top of the signal contacts 146 and the signal wires 104, 106, including some length of the signal wires within the cable 102. The side walls 236, 238 of the upper shield 230 extend along sides of the signal contacts 146. When the upper shield 230 is coupled to the lower shield 232, the side walls 236, 238 of the upper shield 230 engage and are electrically connected to the side walls 256, 258, respectively, of the lower shield 232. Continuous ground paths are created along the sides of the signal contacts 146 by the side walls 236, 238 and the side walls 256, 258. The sides of the signal contacts 146 are continuously covered along the entire length of the signal contacts 146. The upper wall 234 extends along the entire length of the signal contacts 146 to provide electrical shielding above the signal contacts 146 at or beyond the mating ends 210 of the signal contacts 146 to a location rearward of the terminating ends 212. The upper wall 234 may extend along at least part of the ground ferrule 180. The upper wall 234 may cover at least a portion of the cable 102. Similarly, the side walls 256, 258 and the lower wall 254 extend rearward beyond the terminating ends 212 and cover at least part of if not the entire ground ferrule 180 and at least part of the cable 102.

In the illustrated embodiment, the only portion of the signal contacts 146 that are not directly covered by the ground shield 148 is the bottom of the signal contacts 146 forward of the lower wall 254. However, with reference to FIG. 1, the ground shield 148 of the cable assembly 140 below the open bottom provides shielding along the bottom of the signal contacts 146. As such, within the cable header connector 100, each of the signal contacts 146 have electrical shielding on all four sides thereof for the entire lengths thereof by the ground shields 148 of the cable header connector 100. The electrical shielding extends at or beyond the mating ends 210 of the signal contacts 146 to at or beyond the terminating ends 212 of the signal contacts 146. As shown in FIG. 8, the mating ends 210 of the signal contacts 146 extend beyond the front 204 of the mounting block 200 such that the signal contacts 146 are exposed in the shroud 240. No portion of the mounting block 200 is between the mating ends 210, but rather, the mating ends 210 are separated by air and the mating ends 210 of the signal contacts 146 are separated from the shroud 240 of the ground shield 148 by air.

Figure 9:
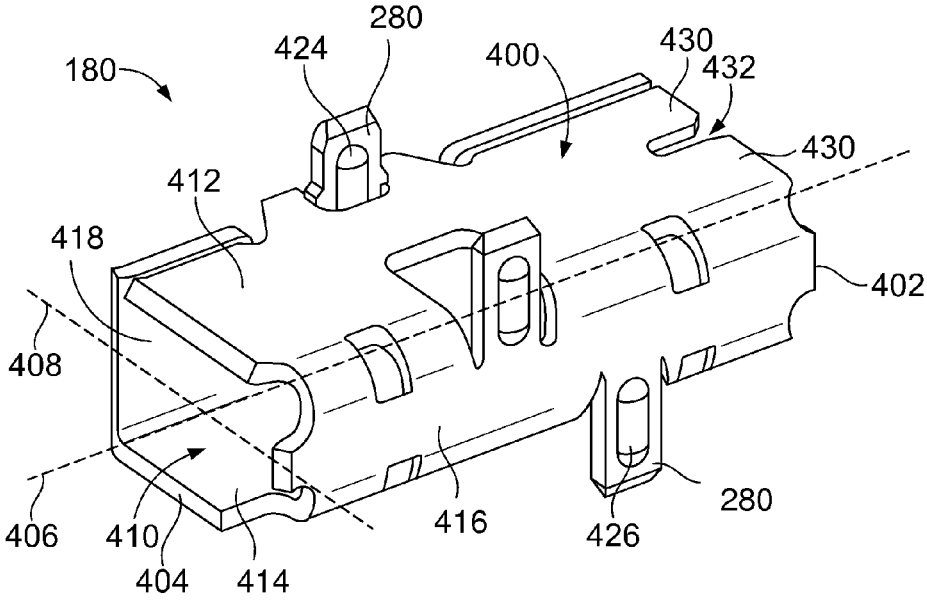
FIG. 9 is a rear perspective view a ground ferrule formed in accordance with an exemplary embodiment for use with the cable assembly.

FIG. 9 is a front perspective view the ground ferrule 180 formed in accordance with an exemplary embodiment. The ground ferrule 180 includes a ferrule body 400 configured to engage and be electrically connected to a grounded element of the cable 102 (shown in FIG. 2). For example, the ferrule body 400 may engage and be electrically connected to the drain wire 110 (shown in FIG. 2) and/or a cable shield of the cable 102 or a braid surrounding the signal wires, 104, 106 (both shown in FIG. 2).

The ferrule body 400 extends between a front 402 and a rear 404. The ferrule body 400 extends along a longitudinal axis 406 between the front 402 and the rear 404. Optionally, the ferrule body 400 may be elongated from side to side along a lateral axis 408. Alternatively, the ferrule body 400 may have a cylindrical shape. The ferrule body 400 includes one or more walls defining a ferrule cavity 410 that is configured to receive a portion of the cable 102. Optionally, the walls of ferrule body 400 may be generally planer and arranged on four sides to define a parallel piped shaped ferrule body 400. Alternatively, the walls of ferrule body 400 may be generally curved defining an elliptical shaped body.

In an exemplary embodiment, the ferrule body 400 includes a first end 412 and a second end 414 generally opposite the first end 412. Sides 416, 418 extend between the first and second ends 412, 414. The first end 412 and second end 414 may be generally planer and parallel to one another. Optionally, the first end 412 may define a top of the ferrule body 400 while the second end 414 defines a bottom of the ferrule body 400. Alternatively, the first end 412 may define a bottom of the ferrule body 400, while the second end 414 defines a top of the ferrule body 400. In an exemplary embodiment, the ferrule body 400 may be arranged within the receptacle 222 (shown in FIG. 5) of the ground shield 148 (shown in FIG. 5) in different orientations. For example, in a first orientation the first end 412 is upward facing, and in a second orientation, the ferrule body 400 is inverted such that the first end 412 is downward facing. The ground shield 148 is configured to receive the ferrule body 400 in either orientation.

The ferrule body 400 includes ferrule tabs 280 extending from the first end 412 and ferrule tabs 280 extending from the second end 414. In an exemplary embodiment, the ferrule tabs 280 are offset with respect to the ferrule tabs 280. For example, the ferrule tabs 280 may be positioned closer to the rear 404, while the ferrule tabs 280 may be positioned closer to the front 402. Optionally, the ferrule tabs 280 may be provided at both sides 416, 418. The ferrule tabs 280 may be formed integral with, and extend from, the sides 416, 418 beyond the first end 412 and/or the second end 414. The ferrule tabs 280 are configured to be received in corresponding ground ferrule slots 248, 262 (both shown in FIG. 5) when the ground ferrule 180 is loaded into the ground shield 148. The ferrule tabs 280 include embossments 424, 426, respectively, extending therefrom. The embossments 424, 426 are configured to engage the ground shield 148 when the ground ferrule 180 is loaded therein. The embossments 424, 426 may engage the ground shield 148 by an interference fit.

The ferrule tabs 280 may be used to secure the ground ferrule 180 to the ground shield 148. The ferrule tabs 280 may be used to secure the upper shield 230 to the lower shield 232 (both shown in FIG. 5). The ferrule tabs 280 may be used to electrically connect the ground ferrule 180 to the ground shield 148. Other types of features may be used in alternative embodiments to secure the ground ferrule 180 to the ground shield 148. Other types of features may be used to electrically connect the ground ferrule 180 to the ground shield 148.

In an exemplary embodiment, the ground ferrule 180 includes one or more features that engage, and are electrically connected to, a grounded element of the cable 102. In the illustrated embodiment, the ground ferrule 180 includes drain wire tabs 430 that define a drain wire slot 432 that is configured to receive the drain wire 110 (shown in FIG. 2) of the cable 102. The drain wire tabs 430 and drain wire slot 432 may define an interference fitting for the drain wire 110. For example, the width of the drain wire slot 432 may be approximately equal to or slightly smaller than the diameter of the drain wire 110 such that the drain wire 110 is securely held in the drain wire slot 432.

In the illustrated embodiment, the drain wire tabs 430 and drain water slot 432 are within the plane defined by the first end 412. For example the drain wire slot 432 extends through the wall defining the first end 412. In alternative embodiments, the drain wire tabs 430 may extend from the first end 412, such as in a direction perpendicular to the first end 412. In other alternative embodiments, similar drain wire tabs and a drain wire slot may be provided in or extend from the second end 414. In other alternative embodiments, other types of features may be provided to electrically connect to the drain wire 110 and/or other grounded elements of the cable 102, such as a cable braid of the cable 102 and/or the signal wires 104, 106 (both shown in FIG. 2). For example, barbs may extend from the ferrule body 400 that pierce the cable 102 to electrically connect the ferrule body 400 to a grounded element of the cable 102.

Figure 10:
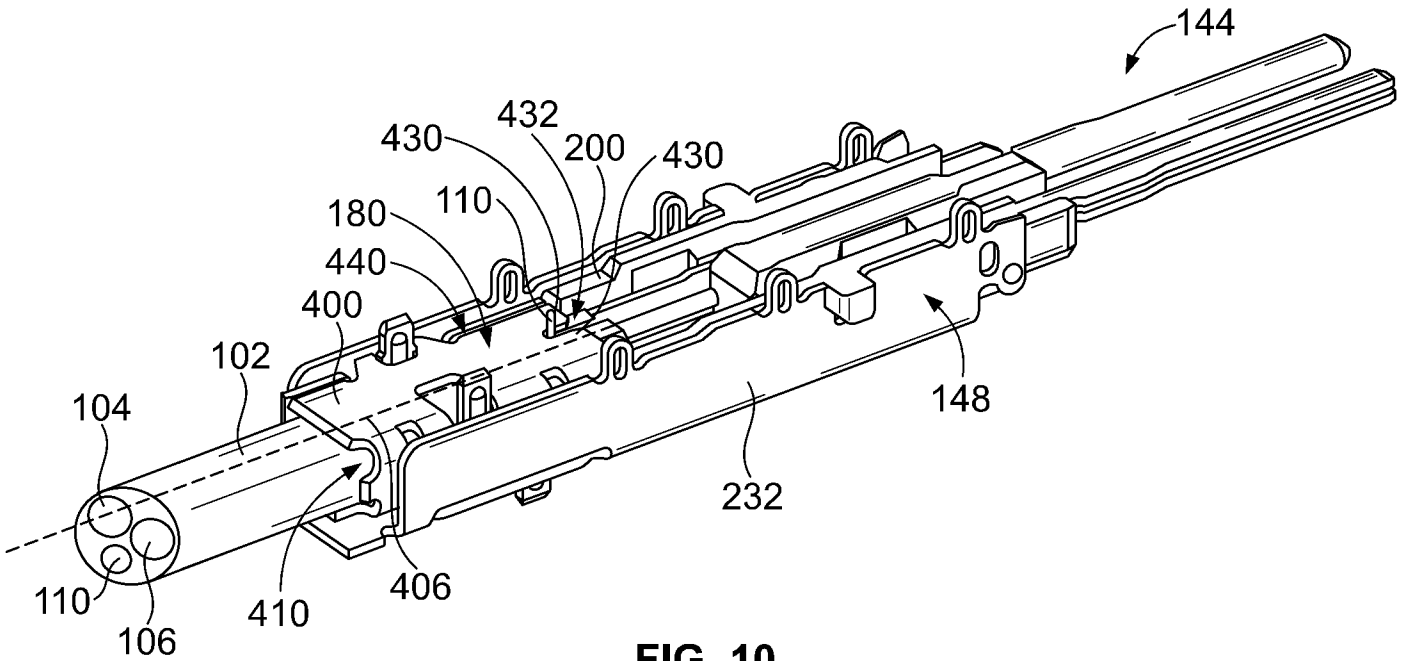
FIG. 10 is a rear perspective view of the ground ferrule connected to an end of a cable.

FIG. 10 is a front perspective view of the ground ferrule 180 connected to the end of the cable 102 and mounted in the lower ground shield 232 behind the contact sub-assembly 144. The drain wire 110 is received in the drain wire slot 432 between the drain wire tabs 430.

During assembly, the ground ferrule 180 is attached to the end of the cable 102. The end of the cable 102 is prepared by stripping the insulation surrounding the signal wires 104, 106 to expose the electrical conductors of the signal wires 104, 106. Cable shields of the signal wires 104, 106 and/or the cable 102 may be folded back over the end of the cable 102. The drain wire 110 may be trimmed to an appropriate length.

The ground ferrule 180 is attached to the end of the cable 102, such as by crimping the ground ferrule 180 to the end of the cable 102. Optionally, the cable 102 may be fed through the ferrule cavity 410 along the longitudinal axis 406. Alternatively, the ferrule body 400 may include a seam 440 that may be opened to provide access to the ferrule cavity 410 and then closed by folding, pressing and/or crimping the walls of the ferrule body 400 around the end of the cable 102.

The drain wire 110 is loaded into the drain wire slot 432 to electrically connect the drain wire 110 to the ground ferrule 180. Optionally, when the ground ferrule 180 is attached to the end of the cable 102, a portion of the ground ferrule 180 may extend beyond the cable braids of the signal wires 104, 106. Optionally, a portion of the ground ferrule 180 may extend beyond the insulation of the signal wires 104, 106.

Once attached to the end of the cable 102, the ground ferrule 180 may be loaded into the ground shield 148, where the ground ferrule 180 is electrically connected to the ground shield 148 to define an electrical path between the grounded element of the cable 102 and the ground shield 148. In an exemplary embodiment, the ground ferrule 180 abuts against the contact sub-assembly 144, such as against the mounting block 200 to provide strain relief for the cable 102.

Figure 11:
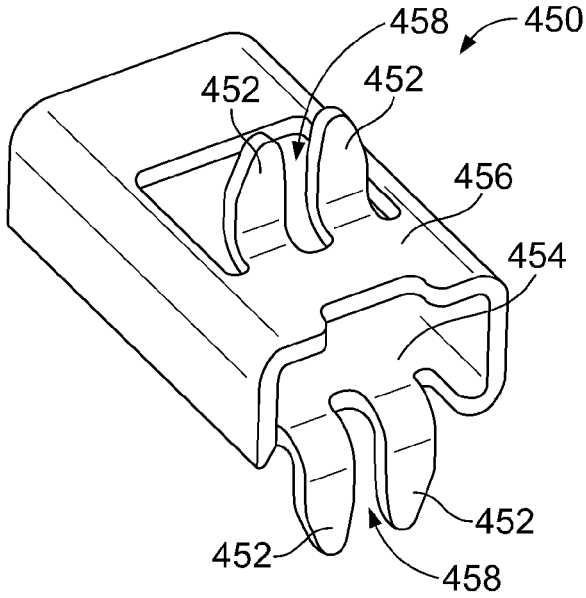
FIG. 11 is a front perspective view of a ground ferrule formed in accordance with an exemplary embodiment.
Figure 12:
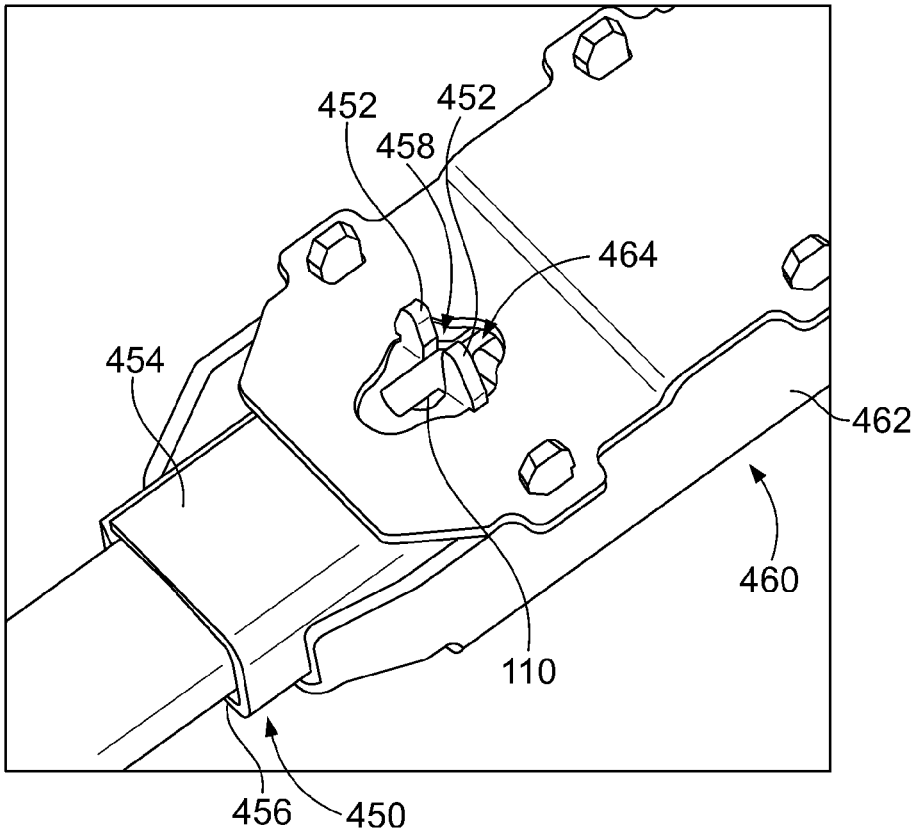
FIG. 12 illustrates a cable assembly that uses the ground ferrule shown in FIG. 11.

FIG. 11 is a front perspective view of an alternative ground ferrule 450 formed in accordance with an exemplary embodiment. FIG. 12 illustrates a cable assembly 460 that uses the ground ferrule 450. The ground ferrule 450 is similar to the ground ferrule 180, however the ground ferrule 450 includes drain wire tabs 452 extending radially outward from first and second ends 454, 456 of the ground ferrule 450. A drain wire slot 458 is defined between the drain wire tabs 452. In an exemplary embodiment, the drain wire tabs 452 extending from the first end 454 are offset with respect to the drain wire tabs 452 extending from the second end 456. Having the drain wire tabs 452 offset allows the cable assemblies 460 of the contact modules to be stacked closer to one another without having drain wire tabs 452 of one cable assembly 460 interfere with drain wire tabs 452 of a cable assembly 460 above or below such other cable assembly 460. The cable assemblies 460 may be more tightly spaced in the contact module.

The cable assembly 460 has a ground shield 462 which may be similar to the ground shield 148 (shown in FIG. 5). The ground shield 462 includes an opening 464 therethrough that receives the drain wire tabs 452. In an exemplary embodiment, the opening 464 is sized to press the drain wire tabs 452 toward one another to reduce the size of the drain wire slot 458 and thus press the drain wire tabs 452 against the drain wire 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable header connector comprising:

a contact sub-assembly having a pair of signal contacts, the signal contacts being configured to be teuninated to corresponding signal wires of a cable;

a ground shield extending along and providing electrical shielding for the signal contacts of the contact sub-assembly, the ground shield having a terminating end, the ground shield having a receptacle at the terminating end surrounding an end of the cable; and a ground ferrule configured to be electrically connected to a grounded element of the cable, the ground ferrule having walls defining a ferrule cavity receiving the cable, the ground ferrule being received in the receptacle such that the ground ferrule is enclosed and surrounded by the ground shield, the ground ferrule having ferrule tabs extending therefrom, the ferrule tabs engaging the ground shield to mechanically and electrically connect the ground ferrule to the ground shield and electrically connect the ground shield to the grounded element.

2. The cable header connector of claim 1, wherein the ground ferrule is coupled to the cable behind the termination of the signal contacts to the signal wires.

3. The cable header connector of claim 1, wherein the ground ferrule is configured to be electrically connected to a drain wire of the cable, the drain wire being electrically connected to grounded cable braids of the signal wires.

4. The cable header connector of claim 1, wherein the ground ferrule includes drain wire tabs that engage a drain wire of the cable by an interference fitting to electrically connect the ground ferrule to the drain wire.

5. The cable header connector of claim 1, wherein the ground ferrule is mounted to the cable immediately rearward of the contact sub-assembly, a front of the ground ferrule engaging the contact sub-assembly to provide strain relief between the contact sub-assembly and the cable.

6. The cable header connector of claim 1, wherein the ground ferrule is electrically conductive, the walls of the ground ferrule comprising first and second ends and first and second sides extending between the first and second ends, the first and second ends and first and second sides defining the ferrule cavity and receiving the cable to provide electrical shielding along a length of the cable.

7. The cable header connector of claim 1, wherein the ground ferrule is configured to be received in the ground shield in a first orientation or a second orientation inverted with respect to the first orientation.

8. The cable header connector of claim 1, wherein the pair of signal contacts define a differential pair carrying differential signals, the ground shield surrounding the differential pair of signal contacts and providing electrical shielding for the differential pair of signal contacts from all other signal contacts, the receptacle receiving the corresponding cable for the differential pair of signal contacts and providing electrical shielding for the cable from all other cables.

9. The cable header connector of claim 1, wherein the ground ferrule has an oblong shape having a width greater than a height, the ground ferrule being shaped to resist rotation of the ground ferrule within the ground shield.

10. A cable header connector comprising:

a cable assembly comprising a contact sub-assembly configured to be terminated to a cable, a ground ferrule configured to be electrically connected to a grounded drain wire of the cable and a ground shield coupled to the ground ferrule and providing electrical shielding for the contact sub-assembly;

the contact sub-assembly having a mounting block supporting a pair of signal contacts, the signal contacts extending between mating ends and terminating ends, the signal contacts being terminated to corresponding signal wires of the cable at the terminating ends;

the ground shield having walls extending along the signal contacts, the walls comprising an upper wall, a lower wall and opposite side walls between the upper and lower walls, the ground shield including a receptacle bounded by the upper wall, lower wall and side walls, the ground shield having a mating end and a terminating end; and the ground ferrule having a ferrule body comprising first and second ends and first and second sides extending between the first and second ends, the first and second ends and first and second sides defining a ferrule cavity configure to receive the cable to provide electrical shielding along a length of the cable, the ground ferrule including drain wire tabs that engage the drain wire of the cable by an interference fitting to electrically connect the ground ferrule to the drain wire, the ferrule body being received in the receptacle and engaging the ground shield to electrically connect the ground shield to the grounded drain wire.

11. The cable header connector of claim 10, wherein the ground ferrule is coupled to the cable behind the termination of the signal contacts to the signal wires.

12. The cable header connector of claim 10, wherein the ground ferrule includes ferrule tabs extending therefrom, the ferrule tabs engaging the ground shield to mechanically and electrically connect the ground ferrule to the ground shield.

13. The cable header connector of claim 10, wherein the ground ferrule is configured to be mounted to the cable immediately rearward of the mounting block, and a front of the ferrule body engaging the mounting block to provide strain relief between the contact sub-assembly and the cable.

14. The cable header connector of claim 10, wherein the ferrule body includes a front and a rear, the terminating end of the ground shield being positioned rearward of the front of the ferrule body such that the ground shield extends along at least a portion of the ferrule body.

15. The cable header connector of claim 10, wherein the ground shield includes ground ferrule slots therethrough, the ground ferrule including ferrule tabs extending therefrom, the ferrule tabs being received in corresponding ground ferrule slots.

16. The cable header connector of claim 10, wherein the ground ferrule includes a first end and a second end, the ground ferrule includes ferrule tabs extending from the first end and from the second end, the ferrule tabs extending from the first end being offset with respect to the ferrule tabs extending from the second end, the ground shield includes ground ferrule slots receiving corresponding ferrule tabs, wherein the ground ferrule is configured to be received in the ground shield in a first orientation or a second orientation inverted with respect to the first orientation, the ground ferrule slots receiving the ferrule tabs in either orientation.

17. The cable header connector of claim 10, wherein the ground ferrule includes a first end and a second end, the ground ferrule includes drain wire tabs extending from the first and second ends and defining drain wire slots therebetween that are configured to receive and be electrically connected to a drain wire of the cable, the drain wire tabs extending from the first end being offset with respect to the drain wire tabs extending from the second end, the ground shield includes drain wire openings receiving corresponding drain wire tabs, wherein the ground ferrule is configured to be received in the ground shield in the first orientation or a second orientation inverted with respect to the first orientation, the drain wire openings receiving the drain wire tabs in either orientation.

18. A cable header connector comprising:

a cable assembly comprising a contact sub-assembly configured to be terminated to a cable, a ground ferrule configured to be electrically connected to a drain wire of the cable and a ground shield coupled to the ground ferrule and providing electrical shielding for the contact sub-assembly;

the contact sub-assembly having a mounting block supporting a pair of signal contacts, the signal contacts extending between mating ends and terminating ends, the signal contacts being terminated to corresponding signal wires of the cable at the terminating ends;

the ground shield having walls extending along the signal contacts, the walls comprising an upper wall, a lower wall and opposite side walls between the upper and lower walls, the ground shield including a receptacle bounded by the upper wall, lower wall and side walls, the ground shield having a mating end and a terminating end; and the ground ferrule having a ferrule body comprising first and second ends and first and second sides extending between the first and second ends, the first and second ends and first and second sides defining a ferrule cavity configure to receive the cable to provide electrical shielding along a length of the cable, the ferrule body having a drain wire slot configured to receive and be electrically connected to the drain wire of the cable, the ferrule body being received in the receptacle and engaging the ground shield to electrically connect the ground shield to the drain wire of the cable.

19. The cable header connector of claim 18, wherein the ground ferrule is configured to be received in the ground shield in a first orientation or a second orientation inverted with respect to the first orientation.

* * * * *